US006695673B1

(12) United States Patent
Stadbauer

(10) Patent No.: US 6,695,673 B1
(45) Date of Patent: Feb. 24, 2004

(54) MECHANICAL ANIMAL REPRODUCTION

(76) Inventor: Andreas Stadbauer, Stanzingstr. 7/11, Elsbethen (AT), A-5061

( * ) Notice: Subject to any disclaimer, the term of this patent is extended or adjusted under 35 U.S.C. 154(b) by 0 days.

(21) Appl. No.: 09/890,301

(22) PCT Filed: Jan. 27, 2000

(86) PCT No.: PCT/EP00/00632

§ 371 (c)(1),
(2), (4) Date: Oct. 29, 2001

(87) PCT Pub. No.: WO00/45916

PCT Pub. Date: Aug. 10, 2000

(30) Foreign Application Priority Data

Feb. 4, 1999 (DE) ..... 299 01 938
Jun. 7, 1999 (DE) ..... 199 25 874

(51) Int. Cl.[7] ..... A63H 3/24
(52) U.S. Cl. ..... 446/305; 446/337; 446/395
(58) Field of Search ..... 446/304, 305, 446/337, 395

(56) References Cited

U.S. PATENT DOCUMENTS

| | | | | |
|---|---|---|---|---|
| 2,802,301 A | | 8/1957 | Lohr | |
| 3,959,919 A | | 6/1976 | Baulard-Cogan | |
| 4,164,092 A | | 8/1979 | Goldfarb et al. | |
| 5,181,877 A | * | 1/1993 | Perkitny | 446/337 |
| 5,304,087 A | * | 4/1994 | Terzian et al. | 446/337 X |
| 5,391,106 A | * | 2/1995 | Lidert | 446/337 |
| 6,210,249 B1 | | 4/2001 | Stadlbauer | |

FOREIGN PATENT DOCUMENTS

DE 197 04 515 8/1998

* cited by examiner

*Primary Examiner*—John A. Ricci
(74) *Attorney, Agent, or Firm*—Lowe Hauptman Gilman & Berner, LLP

(57) ABSTRACT

A mechanical dog has a head and a tongue having at least one channel which opens into a first opening in the tip of the tongue and a second opening at an end of the tongue facing away from the tip of the tongue. The dog has a tank and a suction pump connected to the channel via the first opening. A drive moves the tongue toward or away from the head.

11 Claims, 7 Drawing Sheets

MECHANICAL ANIMAL REPRODUCTION

FIELD OF INVENTION

The invention relates to mechanically simulated animals, in particular a simulated animal having a simulated head with a simulated tongue.

BACKGROUND ART

One prior art simulated mechanical animal already is disclosed by German Gebrauchsmuster 297 02 068.4 wherein at least one hind leg rests on a second pivot. The axes of rotation of first and second pivots of this hind leg are mutually canted at a predetermined angle. A second drive mechanism selectively moves the hind leg about the second pivot. This simulated animal simulates or replicates the behavior of real animals, such as dogs and it simulates in an especially advantageous manner "leg lifting," with corresponding animal relief to scent its territory by using two mutually canted axes of rotation.

German patent 13,951 discloses a toy goat including a simulated joint between its head and neck to suck in liquids by raising and lowering this head, and thus simulating the animal's drinking. A tube to suck in the liquid runs through the neck and the head. However the simulated drinking by this toy can be carried out only in highly complex and strained manner because various parts of the goat, such as head, neck and legs, must be driven manually. This design is unable to meet modern demands for high-fidelity simulated reproduction of animal drinking.

An object of the present invention is to provide a new and improved simulated mechanical animal having additional automated functions and improved operation.

SUMMARY OF THE INVENTION

According to the present invention, a mechanical animal simulating structure comprises a head and a tongue carried by the head, wherein the tongue includes at least one duct issuing within the zone of the tongue tip into at least one first orifice. An end of the tongue away from the tip issuing into at least one second orifice is connected to a liquid tank. A selectively driven suction device sucks liquid through the first orifice into the duct. The tongue is displaceably supported at the head and connected to a drive system that selectively displaces the tongue to extend from, or retract into, the head.

The invention offers the advantage of imitating in a life-like manner by mechanical simulation the actions carried out by real animals. The simulated mechanical animal of the invention includes an additional function, namely accepting liquid such as water from an external container, for instance a cup, to provide a greater range of playfulness and hence a greater play value. The user can bring a container, for instance filled with water, near the mechanical simulator, or reversely the simulated mechanism can approach the water-filled container, in such manner that the first orifice on the tongue tip dips into the water. By activating the suction device, the water is then sucked from the container through the first orifice, the duct and through the second orifice into the liquid receptacle of the simulated animal, thereby giving the impression that the mechanical animal is slurping or splashing water to reduce its thirst.

The automated dipping of the tongue tip including the first orifice is attained in that the tongue, which is displaceably supported at the head, is joined in such manner to a drive device that selectively moves the tongue away from the head.

In a preferred embodiment of the invention, one electrically powered mechanical actuator powers the drive device and another powers the suction device. The two actuators also may be combined into one common drive system.

A manual switch in each case selectively activates the suction device and the drive device. In an especially appropriate manner, the two switches are designed as one common switch. In this manner liquid suction and outward tongue activation to suck in a liquid are actuated jointly. For the purpose of simple and comfortable operation and for a game rich in joy using the simulated animal of the invention, an operating device includes a selector accessible to the operator for transmitting a command to actuate the suction device and/or the drive device to the animal simulating assembly.

To increase game attractiveness by maximizing real-life likenesses regarding the procedure of water intake discussed below, the simulated animal includes a noise generator which is actuated simultaneously with the suction device, to generate a noise imitating the slurping or splashing and drinking noise of an animal.

Because a duct issuing into an orifice in the rear portion of the animal simulating structure is connected to the liquid tank, and because a pump is provided to selectively convey liquid from the tank through said duct to the outside, it is possible to simulate bodily release from the simulated animal. The liquid tank does not require previous manual filling but instead is filled already on account of the water intake through the tongue. In this manner a game involving the simulated mechanical animal is especially realistic and hence is of high quality.

In an alternative embodiment the tongue comprises a second duct and the liquid tank is connected to an aerating and venting device, the second duct of the tongue being connected by a hose to said aerating and venting device.

An especially simple and dimensionally stable design is attained in that a self-supporting frame receives a first and a second gear unit as well their drive motors, the suction device and the liquid tank. Appropriately the pump is mounted in the self-supporting frame.

BRIEF DESCRIPTION OF THE DRAWINGS

The invention is described below in relation to the drawings.

DETAILED DESCRIPTION OF THE DRAWINGS

Figure 1:
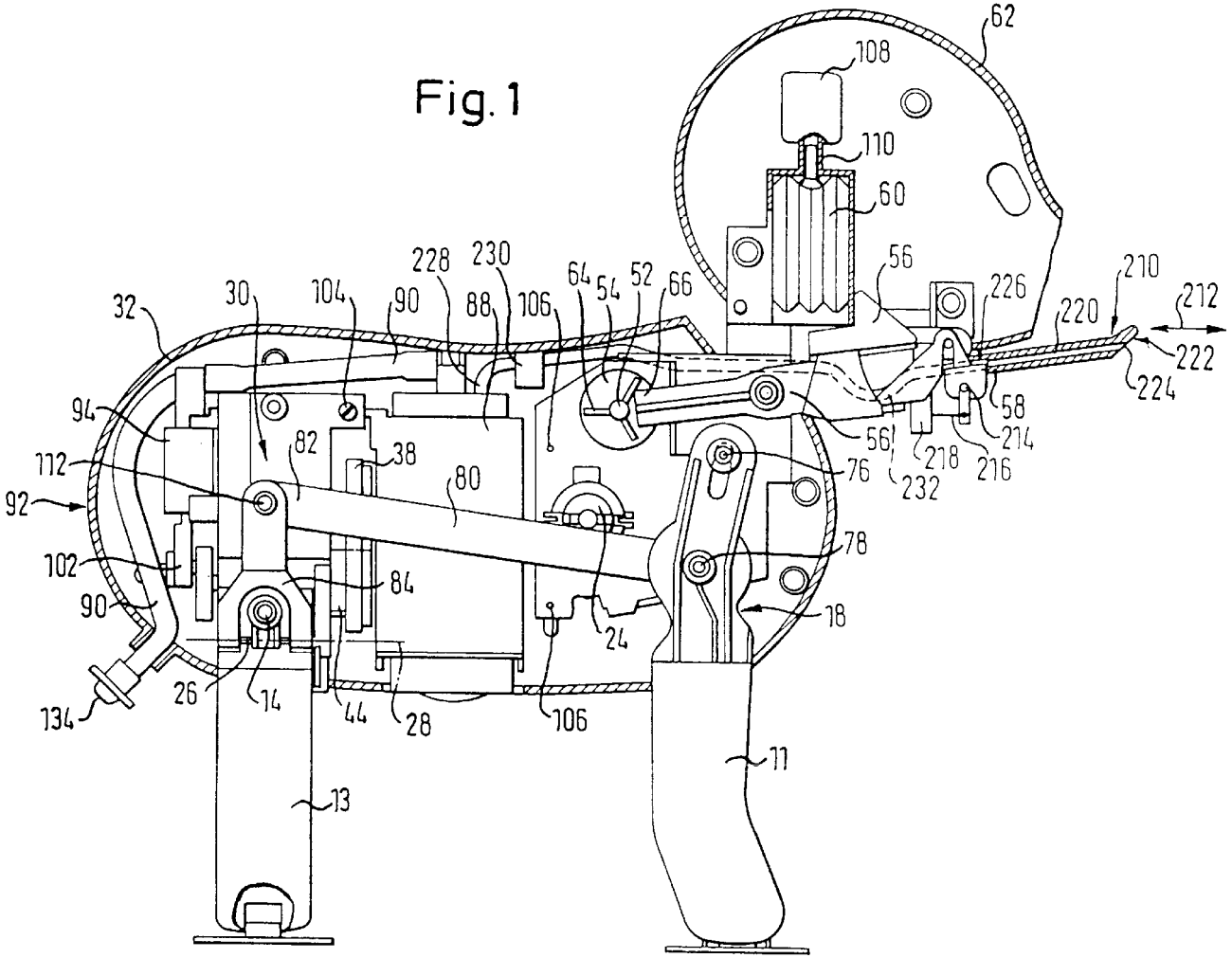
FIG. 1 is a longitudinal sectional view of the simulated mechanical animal in the form of a dog.
Figure 2:
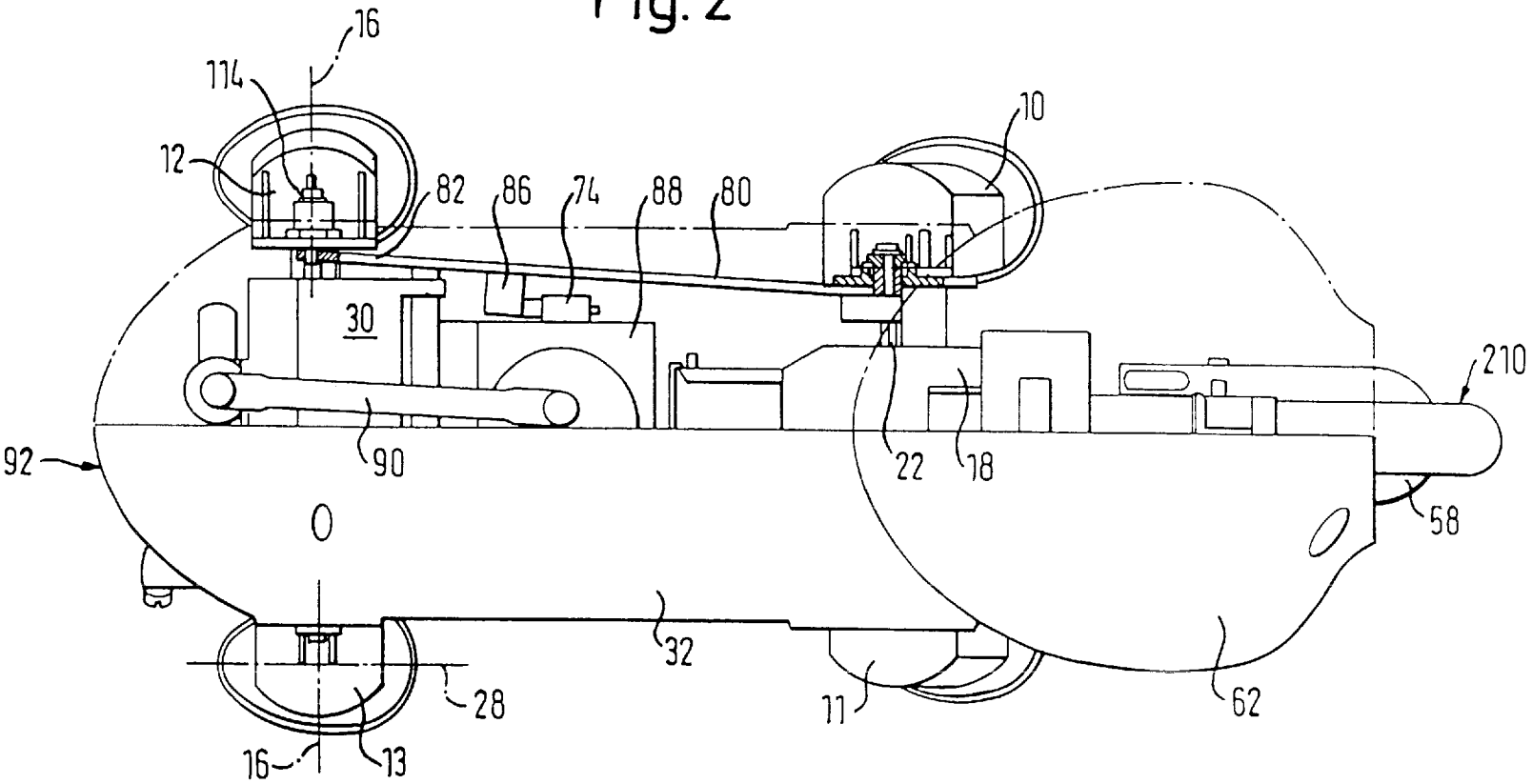
FIG. 2 is a partly sectional topview of the dog illustrated in FIG. 1.

The mechanical dog shown in FIGS. 1 and 2 is fitted inside and at a housing, namely the torso 32, with a first drive mechanism 18, a second drive mechanism 30, fore legs 10 and 11, hind legs 12 and 13, ahead 62 and a water system comprising a liquid tank 88, a liquid tube 90, a liquid pump 94 with piston 102 and discharge aperture 134.

The first drive mechanism 18 is powered by an electric motor 24 selectively driving through a gear unit (not shown), the fore legs 11 or a drive means 54. The fore legs 11 are driven by a first drive shaft 22 (FIG. 2) and an eccentric pivot 78 and moreover can turn about a third pivot 76 and they are displaceably supported along the axle of the fore leg 11. When the fore leg 11 is driven by the motor 24 and the first drive unit 18, the fore leg 11 is alternately raised and lowered on account of the eccentric pivot 78. The corresponding, opposite fore leg 10 (FIG. 2) is raised and lowered in a correspondingly opposite manner. The simultaneous support and guidance at the third pivot 76 additionally provides forward and backward motions of the forelegs 10 and 11. In this manner the mechanical dog is fitted with mechanical, life-like locomotion.

The drive means 54 also is powered by the drive mechanism 18. In this manner the motor 24, acting through the first drive mechanism 18, either drives the drive means 54 or the fore legs 11, 10. In the shown embodiment, the drive means 54 is a disk 54 comprising elevations 64 which, upon turning of said disk about the second drive axle 52, consecutively cooperate with an end 66 of a head lever 56. Head lever 56 is rotated about a pivot and in the process simultaneously actuates a mechanical tongue 58 and a bellows 60. The bellows 60 is first compressed and then released impulsively when an elevation 64 disengages from the end 66 of the head lever 56 on account of the rotation of the disk 54. In the process, air is sucked through a noise generator 108 and a noise maker 110, as a result of which the mechanical dog emits, simultaneously with the tongue motion, a corresponding noise, i.e. a predetermined sound from the noise generator 108. Preferably the noise generator 108 simulates canine barking.

The first drive mechanism 18 also comprises a gear unit 20 fitted with shafts 106; gear unit 20 is described below in detail in relation to FIGS. 4 and 5.

The fore legs 10 and 11 are appropriately connected by a lever 80 to the hind legs 12 and 13. One side of the lever 80 acts on the eccentric pivot 78 of a fore leg 11 and the other end 82 of the lever 80 cooperates through an articulation 112 with a second lever 84 which, by means of the pivot 14 of the corresponding hind leg 13 acts on this pivot. Therefore, when the fore legs 10, 11 are moved by the eccentric drive 78, the corresponding hind legs 12, 13 are driven simultaneously with the fore legs 10, 11 by the lever 80, but in an opposite direction about the pivot 14.

As shown in FIGS. 1 and 2, the mechanical dog also includes a second drive mechanism 30, situated at its rear portion. This second drive mechanism 30 selectively drives the liquid pump 94 or, by means of a disk 38 comprising a cam not seen in FIGS. 1 and 2, the hind leg 13. In addition to the pivot 14, the hind leg 13 is also rotatably supported at the pivot 26 to rotate about an axis of rotation 28. As shown in particular in FIG. 2, the axes of rotation 16 and 28 of the pivots 14 and 26 of the hind leg 13 run substantially orthogonally to each other, and consequently and as regards the normal walk of the mechanical dog, the hind leg 13 pivots to-and-fro by the lever 80 about the pivot 14. However the disk 38 can additionally pivot the hind leg 13 laterally away from the mechanical dog and about the axis of rotation 28 by the second drive mechanism 30. Preferably this pivoting motion materializes when the remaining legs 10, 11 and 12 are standing still, that is when the mechanical dog is not being moved forward. This "leg raising" simulates the action of a real dog relieving itself for instance against a tree trunk. This typical canine behavior to scent their territory therefore can be imitated by the mechanical dog of the invention. When the hind leg 13 is commensurately raised about the axis of rotation 28, the second drive mechanism 30 actuates the plunger 102 of the liquid pump 94 and moves liquid out of tank 88, through the liquid tube 90 and to a discharge 134 of the tube 90 at the rear of the mechanical dog. The liquid issues at the discharge 134 and the mechanical dog faithfully reproduces the action of a dog relieving itself.

The forward motion generated by the first drive mechanism 18 and the operation initiated by the second drive mechanism 30 of the dog relieving itself is selectively provided, that is, either one of the above drive mechanisms is operated.

Using a drive element (not shown), an operator can selectively command the desired function, namely walking forward or dog voiding. However, if the mechanical dog is in the "walk forward" function and "voiding dog" were initiated directly upon switching the drive means by the user, it might happen that the fore legs 10, 11 and the hind leg 12 would be in so adverse a configuration that upon raising the hind leg 13, the mechanical dog would tip over. To prevent this eventuality, the voiding-dog function is initiated only in a given configuration of the legs 10, 11 and 12. The optimal leg position is such that the fore leg 10 diagonally opposite the raising hind leg 13 subtends a horizontally smaller space between the drive axle 22 and the ground than the remaining legs 11 and 12. In this configuration the mechanical dog assumes a stable tripod position.

The voiding-dog function in the stable tripod position is initiated in the embodiment of FIG. 2 by actuating a switch 74 using a drive means 86 at the lever 80 between the fore and the hind legs 1.0 and 12 resp. As shown in FIG. 2, the switch 74 is actuated by the drive means 86 only when the lever 80 and thereby the fore leg 10 have attained their foremost positions while simultaneously the legs 11 and 12 have been pivoted into a rear position. Legs 11 and 12 thereby are vertically farther away from the ground with respect to the drive axle 22 than the fore leg 10 and consequently the mechanical dog rests on the ground.

Therefore, when commanding the voiding-dog function during a forward walk operation, the dog keeps on going somewhat farther until the corresponding position of the legs 10, 11 and 12 has been adjusted and the drive means 86 actuates the switch 74. Thereupon switch 74 initiates operation of the second drive mechanism 30 and stops the first drive mechanism 18. In this process the operating system and the selector at it are so connected with the drive mechanisms 18 and 30 and the switch 74 that switching can take place only when such switching was commanded by the operator by means of the selector at the operating system. So long as this shall not be the case, while in fact the drive means 86 constantly actuates the switch 74 during forward walking, a corresponding electric circuit precludes initiating the second drive mechanism 30.

If vice-versa, during the voiding dog function in the mode of the raised hind leg 13, an operator again should command the walk forward mode, the transition from the drive mechanism 30 to the drive mechanism 18 does not take place impulsively. Instead, for a specific position of the disk 38, a further switch (not shown) is actuated. Preferably the position of the disk 38 is selected in such manner that the hind leg 13 is fully on the ground and so that the dog can walk forward without danger of the dog tipping over. Again the delay in passing from the drive mechanism 30 to the drive mechanism 18 is provided by appropriately wiring the operating element to the drive mechanisms 18, 30 and to the corresponding switches.

As further shown in FIGS. I and 2, the connections of the hind legs 12 and 13 differ basically from each other, depending on the additional function of the hind leg 13. Whereas, and as indicated in FIG. 2, the hind leg 12 is rotatably affixed about the axis 16 by means of a screw 114, the hind leg 13 has two axes of rotation 16 and 28. In order to impart freedom of rotation to the hind leg 13 both about the axis 16 and the axis 28, the second lever 84 must be designed correspondingly. As shown in FIG. 1, lever 84 runs like a horseshoe around the pivot 14 and at the open end of this horseshoe subtends the additional axis of rotation 28.

The two drive mechanisms 18 and 30 are mounted rigidly and immovably to each other in the housing 32. The second drive mechanism 30 is illustratively affixed by a screw 104 to a shell portion of the torso 32.

Figure 3:
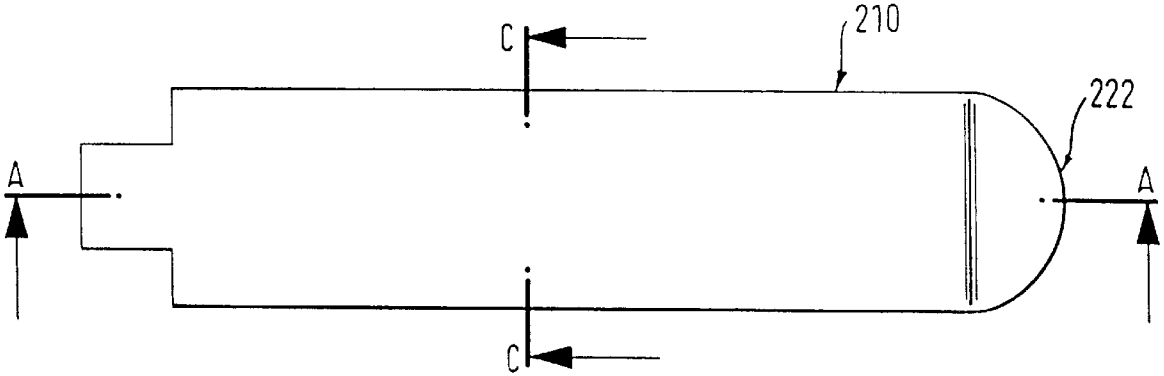
FIG. 3 is a topview of the dog's tongue.
Figure 4:
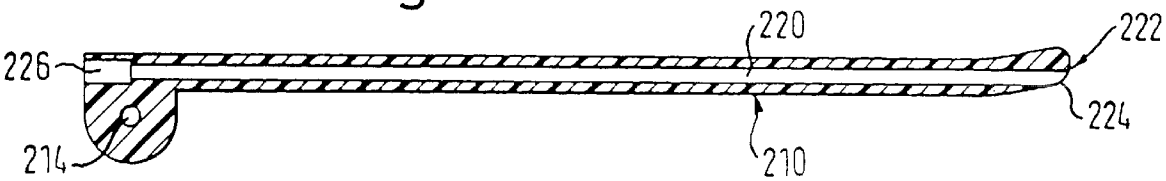
FIG. 4 is a longitudinal section along line A—A of FIG. 3.
Figure 5:
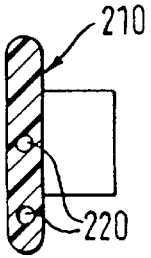
FIG. 5 is a cross-section along line C—C of FIG. 3.
Figure 6:
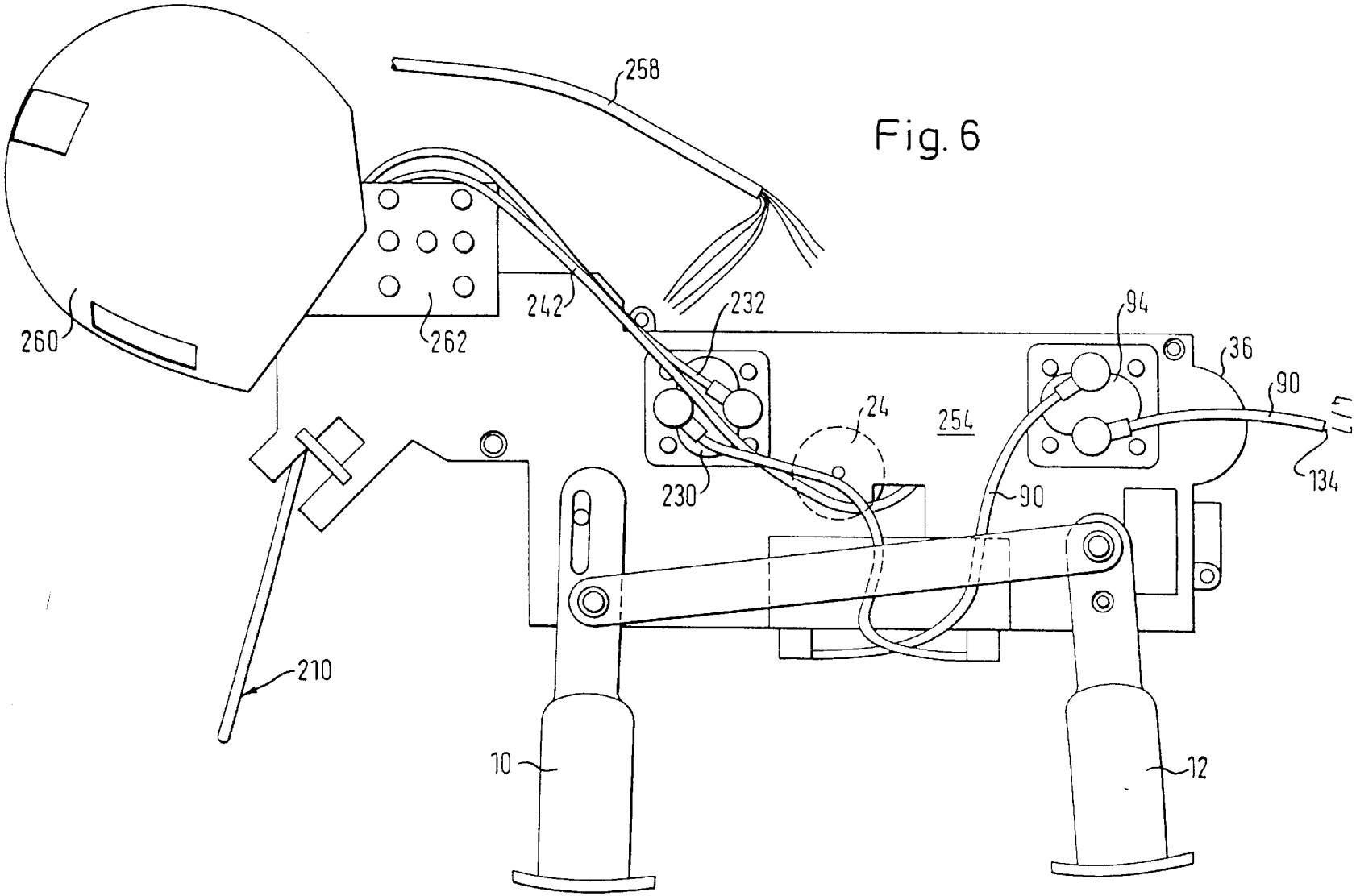
FIG. 6 is a sideview from the left of an alternative embodiment of the animal simulation assembly.
Figure 7:
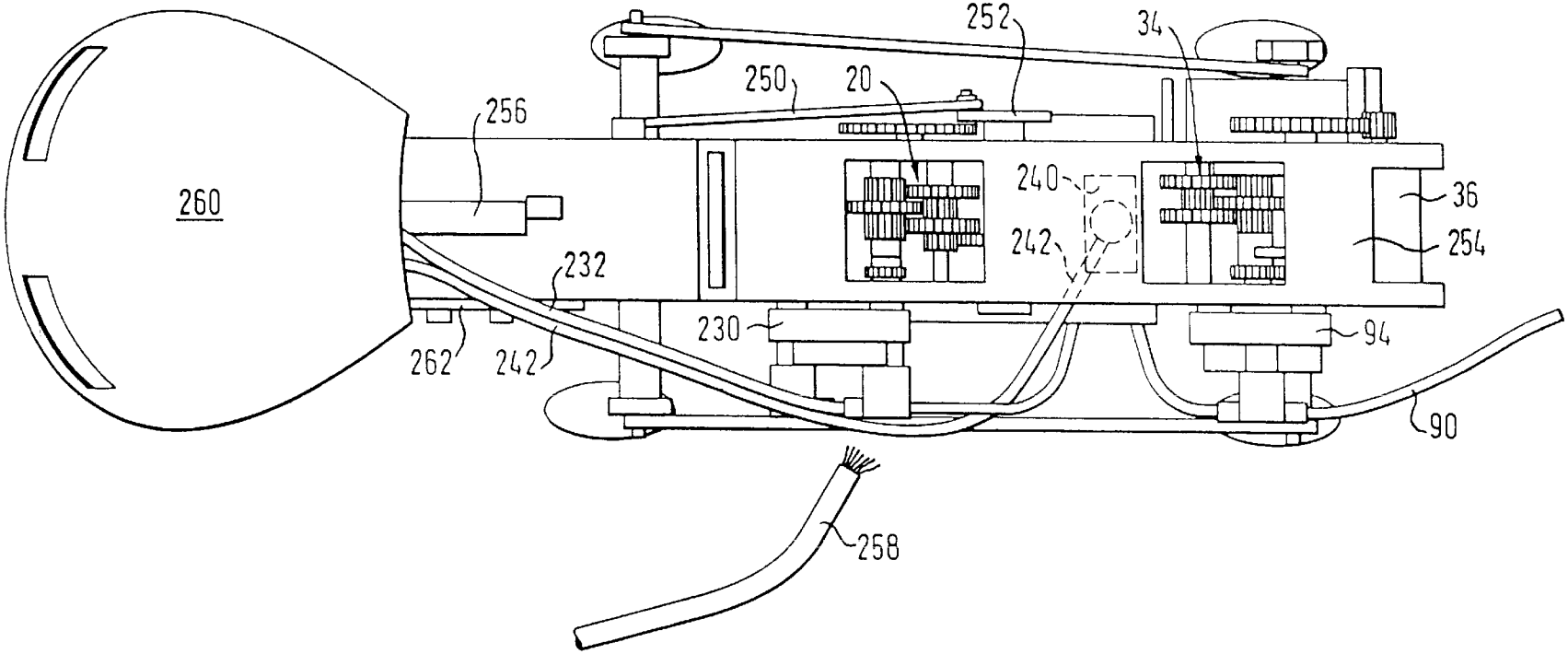
FIG. 7 is a topview of the assembly illustrated in FIG. 6.

As shown in particular detail in FIGS. 3–5, the tongue 58 comprises a portion 210 displaceably mounted in the direction of the arrow 212 onto the head part 62. The tongue portion 210 is connected by an aperture 214 and by a linkage 216 entering the aperture to a drive device 218. Drive device 218 selectively displaces the tongue 210 in the direction of the arrow 212 away from the head or retracts the tongue toward the head. This motion illustratively is implemented by a plunger-like motion of the linkage 216.

The tongue portion 210 comprises a duct 220 issuing into a first orifice 224 at a tongue tip 222. The duct 220 issues into a second aperture 226 at an end opposite the tongue tip 222.

As shown in FIG. 1, the second aperture 226 is connected to a liquid tube 228 and to a suction device 230. The liquid tube 228 issues into the liquid tank 88. The suction device 230 can be operated by an omitted drive mechanism to suck in liquid through the tongue 210.

FIG. 1 shows a retracted state of the tongue 210 and the liquid tube 228 running in an arc 232 from the second aperture 226. When the drive device 218 advances the tongue portion 210, the liquid tube 228 accordingly has enough play and the arc 232 straightens during the extension of the tongue 210.

When playing, an operator uses a switch which actuates both the drive device 218 and the suction device 230. Thereupon the drive device 218 extends the tongue 210 and as a result (when the simulated mechanical animal includes an appropriately positioned external container containing, for instance, water) by its tip 222 of tongue 210 and the first orifice 224 dip into the water in said container. In response to activation of suction device 30 and after the first orifice 224 has dipped into the water, liquid is sucked out of the external liquid container through the first orifice 224, the duct 220, the second orifice 226 and the liquid tube 228 and is moved into the inner liquid tank 88 of said simulated structure, whereby tank 88 is gradually filled. At the same time the external liquid container gradually is emptied and the perception builds up on the outside that the mechanical simulated animal drinks water because it is thirsty. Simultaneously noise generator (not shown) generates a noise imitating the sound of a water-drinking dog (splashing/slurping).

After the liquid tank 88 has been at least partly filled with liquid, for instance water, the suction device 230 is deactivated by again operating the switch and the drive device 218 is controlled in such a way that the tongue 210 and duct 220 are again retracted.

Following another control of the mechanical simulated animal in such a way that the fore legs 10, 11 or the hind legs 12, 13 entail its forward motion, the above function of the voiding animal can be initiated because henceforth there is enough liquid in the liquid tank 88 for said function. At the same time there is a full play sequence, which mimics life very effectively because the simulated mechanical animal precisely voids that liquid which it previously collected through the tongue 210 and the duct 200.

As shown in FIG. 5, the tongue 210 is fitted with two mutually parallel and separate ducts 220. This design advantageously raises the liquid flow through the tongue 210.

Figure 8:
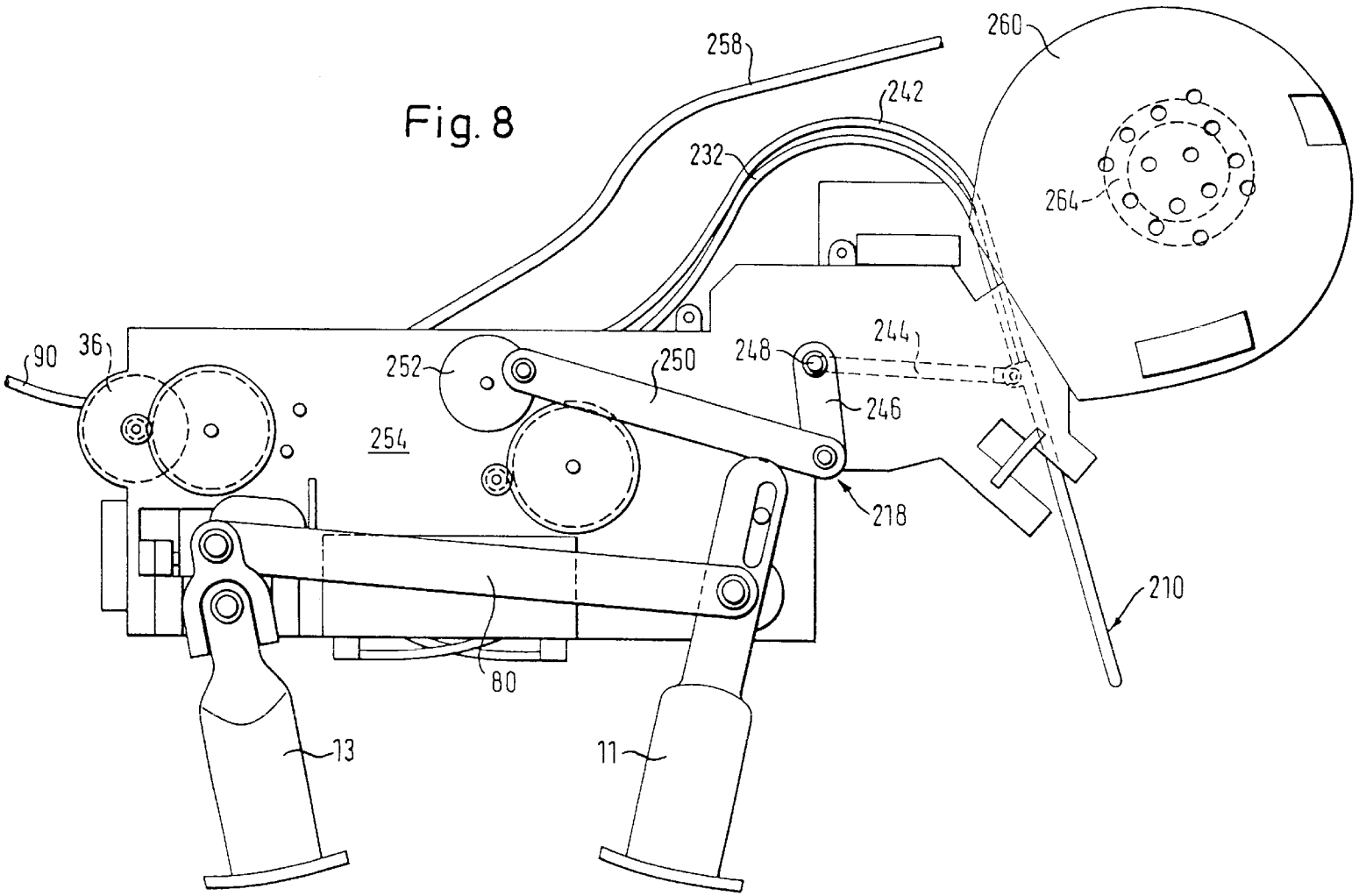
FIG. 8 is a view from the right of FIG. 6.
Figure 9:
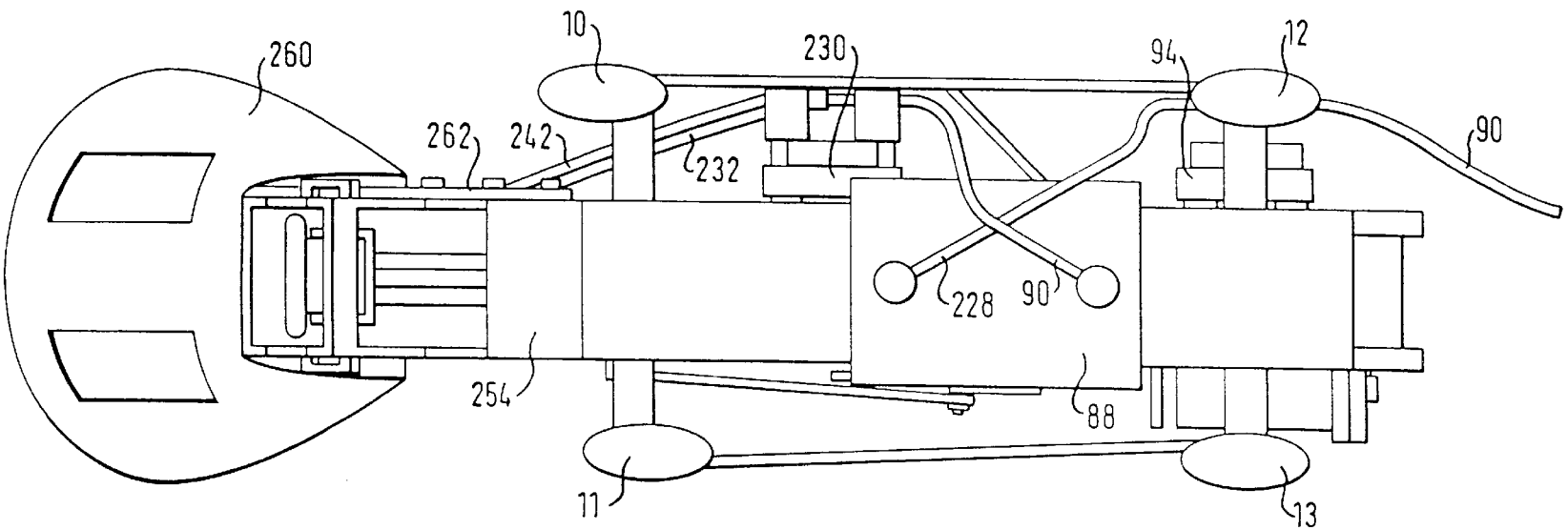
FIG. 9 is a view of FIG. 6 from below.

The embodiment variation shown in FIGS. 6 through 9 includes a self-supporting frame 254 to which are linked the fore legs 10, 11 and the hind legs 12, 13. The following components also are mounted in said self-supporting frame 254: a first gear unit 20, a second gear unit 34, a motor powering the first gear unit 20, a second motor 36 powering the second gear unit 34, a suction device 230, a liquid pump 94 and the liquid tank 88. The drive system 218 is mounted at a front zone of the self-supporting frame 254 (FIG. 8). This drive system 218 comprises a first lever 244 rigidly joined to the tongue 210 and rotatably supported at its end away from the tongue 210 on a pivot 248, and irrotationally connected to a second lever arm 246. The end of arm 246 remote from pivot 248 is connected to a drive bar 250. The end of the drive bar remote from the second lever arm 246 articulates on a driven rotary disk 252. The driven rotary disk 252 is powered by the first gear unit 20. The design of the first gear unit 20 is such that the force from the motor 24 applied to this first gear unit 20 is transmitted in direction of rotation of said motor to the fore legs 10, 11 and hind legs 12, 13 to generate locomotion of the simulated mechanical animal, whereas, in the opposite direction of rotation of said motor, its force is transmitted by means of the rotary disk to the drive system 218. An appropriate limit switch 256 records the excursion of the first lever arm 244, as a result of which this arm can only be pivoted through a given angle to retract or extend the tongue 210. As soon as the tongue 210 has been extended by a predetermined length from the front zone of the self-supporting frame 254, the suction device 230 is automatically activated to move a liquid, for instance water, by the tongue 210 and through the liquid tube 228 into the liquid tank 88, provided that the tip of the tongue 210 dips into the liquid. To allow easy filling of liquid tank 88, an aerating and venting device 240 simultaneously is connected through a tube fitting 242 to a second duct 240 of the tongue 210. When a command to terminate liquid suction is issued from an operating device (not shown) connected by a cable 258 to the simulated mechanical animal, the suction device 230 immediately stops and the tongue 210 is retracted again by a corresponding rotation of the rotary disk 252.

The liquid tank 88 is connected by a tube 90 to the liquid pump 94 which in turn is connected by another liquid tube 90 to the discharge 134. Following an appropriate command from an operational device (not shown), the liquid pump 94 is initiated and then moves liquid from the tank 88 through the tubes 90 to the discharge 134. Again the aerating and venting device 240 jointly with the tube 242 supports draining the liquid tank 88 because air is able to enter said liquid tank 88 through the second duct 240 of the tongue 210 and the tube 242 through the aeration and ventilating device 240.

The second motor 36 and the gear unit 34 drive both the liquid pump 94 and the hind leg 13. The second gear is designed in such manner in this respect that when powered by the motor 36, it first moves the fore legs 10, 11 and the hind leg 12 into a stable tripod position and then it pivots the hind leg 13 to the side and up. Only then is the liquid pump 94 activated to move liquid out of the tank 88 through the tubes 90 to the discharge 134 from which this displaced liquid then is emitted in the form of a fine jet. As soon as the operational device (not shown) emits the command to terminate pumping liquid out of the liquid tank 88, the pump 94 stops and the second gear unit 34 then pivots the hind leg 13 back and returns the fore legs 10, 11 and the hind legs 12, 13 into their walk positions. Alternatively the pivoting motion of the fore legs 10, 11 and of the hind legs 12 into a stable tripod position is carried out by the first gear unit 20 driven by the motor 24. In response to legs 10–12 attaining the stable tripod position, a limit switch is actuated which (1) stops the first motor 24 and thereby the first gear unit 20 and (2) activates the second motor 36 and thereby the second gear unit 34 into (a) pivoting outward the hind leg 13 and (b) moving the liquid by means of the pump 94.

In FIGS. 6–9 is shown a head shell 260 mounted to the front zone of the self-supporting frame 254. Head shell 260 carries both a noise generating electronics 262 and a loudspeaker 264.

Two torso shells (not shown) are mounted around the self-supporting frame 254 together with their corresponding fittings and, while at least partly enclosing the frame 254, are detachably connected to each other and constitute a torso of the simulated mechanical animal. A pelt is slipped over, and sewn together on, said torso shells, the head shell 260, the fore legs 10, 11 and the hind legs 12, 13. The pelt includes a simulation of the head. This pelt completely covers the fore legs 10, 11, the hind legs 12, 13, the torso shells and the head shell 260, and accordingly those parts no longer are visible from the cable 258 and the discharge 134 project from the pelt.

What is claimed is:

1. A mechanical animal simulating structure, comprising a head and a tongue mounted to the head, the tongue comprising at least one duct issuing within the zone of the tongue tip into at least one first orifice and, at an end of the tongue away from said tip issuing into at least one second orifice connected to a liquid tank and to a suction device arranged to be selectively driven for sucking-in liquid through the first orifice and the duct, the tongue being displaceably supported at the head and being connected in such a way to a drive system that the drive system is arranged for selectively displacing the tongue to extend from, or retract into, the head.

2. Animal simulation as claimed in claim 1, wherein a first electrically powered, mechanical drive system is arranged to power the drive device.

3. Animal simulation as claimed in claim 1, wherein a second, electrically powered mechanical drive system is arranged to power the suction device.

4. Animal simulation as claimed in claim 3, wherein the first and second drive systems are combined into a joint mechanical drive system.

5. Animal simulation as claimed in claim 1, further comprising a noise generator arranged to be activated simultaneously with the suction device and to emit a noise imitating a splashing/slurping noise of a drinking animal.

6. Animal simulation as claimed in claim 1, wherein the structure includes a torso, and further comprising a tube connected to the liquid tank and issuing at the rear portion of the torso of said simulation into an aperture and a pump for selectively moving liquid contained in the liquid tank through the tube to the outside.

7. Animal simulation as claimed in claim 6, wherein the pump is mounted in the torso.

8. Animal simulation as claimed in claim 1, wherein the tongue comprises a second duct and the liquid tank includes an aerating and venting device, the tongue's second duct being connected to the aerating and ventilating device of the liquid tank by a tube connection.

9. Animal simulation as claimed in claim 1, wherein the drive device includes a first lever which is firmly joined to the tongue and which is rotatably supported at its end remote from the said tongue on a pivot and which further is irrotationally connected to a second lever arm having an end remote from the pivot connected to a drive bar, the drive-bar having, an end that is remote from the second lever arm the lever arm being arranged to articulate in an eccentric manner on a driven rotary disk.

10. Animal simulation as claimed in claim 1, wherein the structure includes: a self-supporting frame receiving (a) first and a second gear units and (b) drive motors, for the first and second gear units, respectively, (c) a further suction device and (d) the liquid tank.

11. Animal simulation as claimed in claim 10, wherein the pump is mounted in the self-supporting frame.

* * * * *